US005805654A

United States Patent [19]

Wood et al.

[11] Patent Number: 5,805,654

[45] Date of Patent: Sep. 8, 1998

[54] REGENERATIVE LOMI DECONTAMINATION PROCESS

[76] Inventors: Christopher J. Wood, 1656 Fordham Way, Mountain View, Calif. 94040; David Bradbury, Pencot, Tresham, Wotton-under-Edge, Glos GL12 7RW; George Richard Elder, Courtlea, Northwood Green, Westbury-on-Severn, Glos. GL14 1ND, both of United Kingdom

[21] Appl. No.: 826,835

[22] Filed: Apr. 8, 1997

[51] Int. Cl.[6] ..... G21F 9/28

[52] U.S. Cl. ..... 376/313; 376/306; 376/310; 134/3; 134/13; 510/110

[58] Field of Search ..... 376/305, 306, 376/309, 310, 313; 510/110, 247, 253; 134/3, 13, 41

[56] References Cited

U.S. PATENT DOCUMENTS

| | | | |
|---|---|---|---|
| Re. 34,613 | 5/1994 | Hanulik | 252/628 |
| 4,162,229 | 7/1979 | Loewenschuss | 252/301.1 |
| 4,175,011 | 11/1979 | Spiliotis | 204/15 |
| 4,470,951 | 9/1984 | Bradbury et al. | 376/310 |
| 4,705,573 | 11/1987 | Wood et al. | 134/3 |
| 4,731,124 | 3/1988 | Bradbury et al. | 134/3 |
| 4,915,781 | 4/1990 | Bohnen et al. | 156/664 |
| 5,078,842 | 1/1992 | Wood et al. | 204/1.5 |
| 5,132,076 | 7/1992 | Corpora et al. | 376/310 |
| 5,171,519 | 12/1992 | Corpora et al. | 376/310 |
| 5,305,360 | 4/1994 | Remark et al. | 376/309 |
| 5,306,399 | 4/1994 | Bradbury et al. | 204/1.5 |
| 5,340,505 | 8/1994 | Hanulik et al. | 588/18 |
| 5,517,539 | 5/1996 | Corpora et al. | 376/310 |
| 5,520,813 | 5/1996 | Korin et al. | 210/638 |

FOREIGN PATENT DOCUMENTS

| | | |
|---|---|---|
| 0 483 053 A1 | 4/1992 | European Pat. Off. . |
| WO 85/04279 | 9/1985 | WIPO . |

OTHER PUBLICATIONS

Bradbury, D., Segal, M. G., Sellers, R. M., Swan, T., and Wood, C. J., "Development of LOMI Chemical Decontamination Technology," *Research Project 1329–1,* Final Report, Jul. 1983.

Allen, Geoffrey, C.; Kirby, Colin; and Sellers, Robin, M.,The Effect of the Low–oxidation–state Metal Ion Reagent Tris–picolinatovanadium (II) Formate on the Surface Morphology and Composition of Crystalline Iron Oxides, *J. Chem. Soc.,* Faraday Trans. 1, 1988, 84(1), 355–364.

(List continued on next page.)

*Primary Examiner*—Daniel D. Wasil
*Attorney, Agent, or Firm*—Dergosits & Noah LLP

[57] ABSTRACT

A method for operating the LOMI decontamination process in a regenerative manner. The method incorporates an initial injection of a dilute LOMI solution (vanadous formate, picolinic acid and sodium hydroxide) into a decontamination circuit followed by operation of a small cluster of cation exchange columns during the decontamination process. The cation exchange resin is used to remove metals in the same manner as in prior decontamination processes but operation of the cation exchange resin is continued to allow picolinic acid initially bound to the cation exchange resin to be released and recycled to the LOMI solution. Operation of the cation exchange columns ceases after the picolinic acid has been released but before the metals (e.g. sodium, iron and vanadium) are released back to the LOMI solution. The cluster of cation exchange columns are operated according to a sequence wherein one column is releasing picolinic acid while another is binding picolinic acid. The method further includes continuous additions of vanadous formate and sodium hydroxide. Clean-up at the end of the method proceeds in the normal manner wherein larger cation and anion exchange columns are utilized. Because the concentration of the components is much lower than conventional LOMI processes, however, the amount of cation exchange resin required at this stage is greatly reduced.

10 Claims, 3 Drawing Sheets

PROCESS DIAGRAM

OTHER PUBLICATIONS

Suwa, Takeshi; Kuribayashi, Nobuhide; and Tachikawa, Enzo,Development of Chemical Decontamination Process with Sulfuric Acid–Cerium (IV) for Decommissioning, *Journal of Nuclear Science and Technology,* vol. 25, No. 7, pp. 574–585, Jul. 1988.

Pettit, P. J.; LeSurf, J. E.; Stewart, W. B.; Strickert, R. J.; and Vaughan, S. B., *Decontamination of the Douglas Point Reactor by the Can–Decon Process,* The International Corrosion Forum Devoted Exclusively to the Protection and Performance of Materials, Paper No. 39, Mar. 6–10, 1978.

1988 JAIF International Conference on Water Chemisry in Nuclear Power Plants—Operational Experience and New Technologies for Management, Proceedings vol. 2, Apr. 19–22, 1988.

Full System Chemical Decontamination Workshop, Proceedings, Jun. 4–5, 1991.

Waste Processing, Transportation, Storage and Disposal, Technical Programs and Public Education; vol. 1—Low–Level Waste, 1988.

Bishop, J. V.; Dutcher, R. A.; Fisher, M. S.; Kottle, S.; and Stowe, R. A., *Continuous Spectrographic Analysis of Vanadous and Vanadic Ions,* Oct. 31, 1993.

*Carbon Steel and Related Alloy Corrosion in LOMI Decontamination Solvents,* WHC–SA–0465 (no date).

Fuduan, Huang, *Study on LOMI Decontamination Technology* (no date).

Johnson, Jr., A. B.; and Battelle, B. Griggs,*Investigation of Chemicals and Methods of Dilute Reagent Decontamination for Potential Application in Light Water Reactors,* 1978.

Makai, J. et al., *Investigation of V(II) and Cr(II) Compounds for Cleaning of Steam Generators at Paks Nuclear Power Plant Ltd.,* 1992.

PICOLINIC ACID, SHOWING PROTONATION

PICOLINIC ACID AND METAL ION BREAKTHROUGH CHARACTERISTICS ON IR-120 RESIN

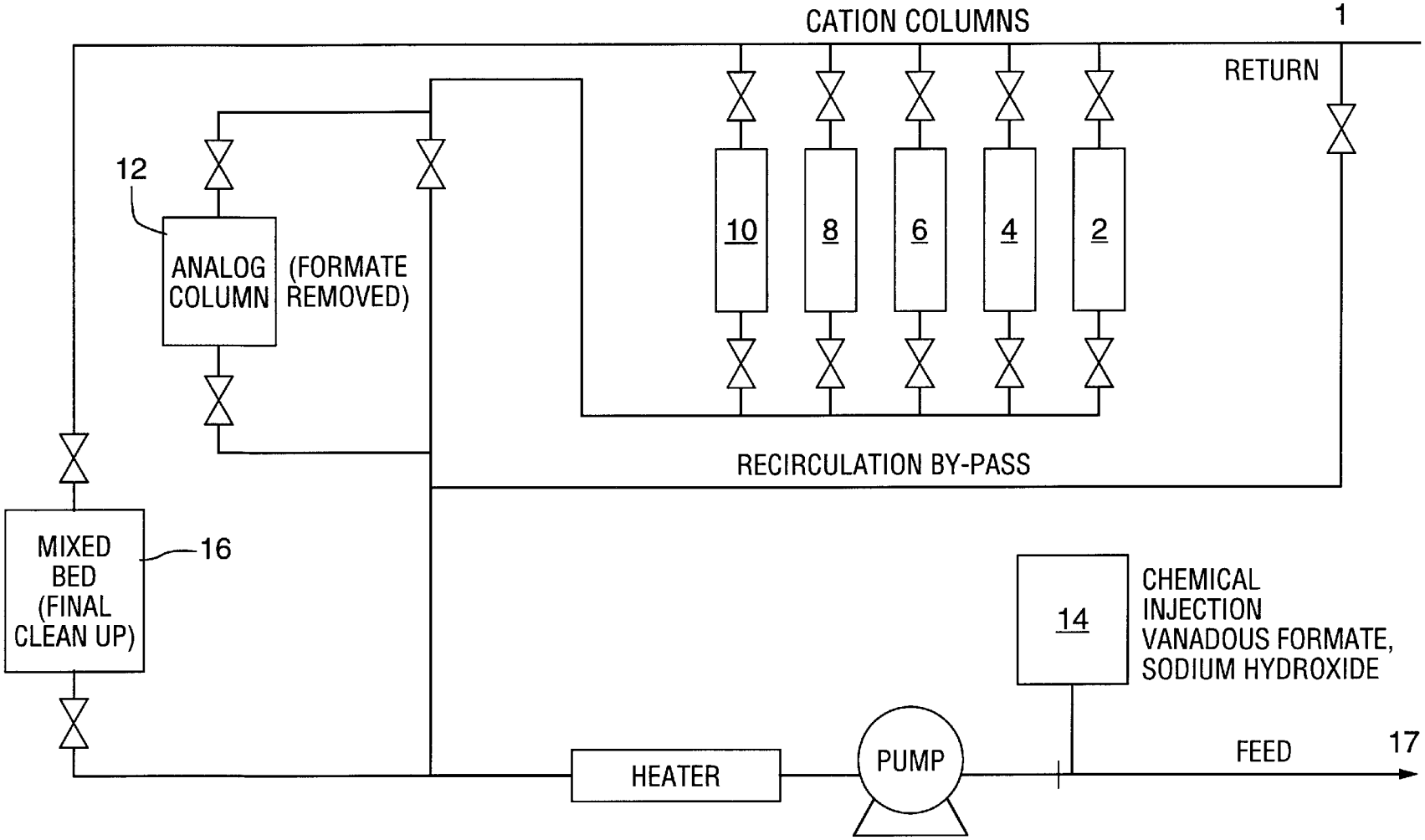
FIG. 3 PROCESS DIAGRAM

REGENERATIVE LOMI DECONTAMINATION PROCESS

TECHNICAL FIELD

This invention relates to a system for improving Light Water Reactor (LWR) decontamination processes. More particularly, the present invention is a regenerative Low Oxidation-state Metal Ion (LOMI) decontamination process which is an improvement of U.S. Pat. Nos. 4,705,573 and 4,731,124, herein incorporated by reference.

BACKGROUND OF THE INVENTION

Decontamination of the sub-systems of LWR plants has now become relatively common in the U.S. and is widely recognized as a useful contributor to reducing plant workers to radiation exposure. The principle of such decontamination procedures is that a part of the reactor circuit is exposed to decontamination chemical solutions which dissolve the radioactive deposits. The spent decontamination chemical solutions are then treated by ion exchange. In this way, the ion exchange resin retains all of the chemical and radioactive burden of the decontamination chemical solution while clean water is returned to the system.

The LOMI process has been widely applied in the United States for decontamination of reactor subsystems. One primary advantage of the LOMI process is its low corrosiveness toward reactor materials. Additionally the process is the only one qualified for use on in-core components of boiling water reactors (BWR).

Application of the LOMI process is effectively limited to a concentration of 10 mM vanadium because of the limited solubility of vanadium species. Because the vanadium dissolves the radioactive corrosion product (contaminated material) and the LOMI process is applied by initial injection, dissolution and clean up (rather than continuous purification), there is a limit as to how much corrosion product can be dissolved in a given volume of decontamination chemical solution (i..e. the decontamination chemical solution has a limited capacity). In most sub-system decontaminations this is not a problem, but in some potential applications, such as the bottom of BWR reactor vessels, the amount of corrosion product present might be greater than the amount which a standard LOMI application can dissolve.

The LOMI decontamination process has been considered a "once through" process due to the fact that the LOMI decontamination chemical solution uses picolinic acid as the chelant and, through protonation of the nitrogen atom in the heterocyclic structure (see FIG. 1), the molecule can bind to a cation exchange resin. Therefore, during the initial phase of the cation exchange process, no picolinic acid comes out of the cation exchange column. This has led to the standard LOMI decontamination process wherein the decontamination solution is applied by initial injection, dissolution and clean-up. What is needed, is an improved LOMI decontamination process which allows for the LOMI decontamination chemical solution to be used in a regenerative manner. This will allow for clean-up of a greater amount of corrosion product using a given LOMI application.

SUMMARY OF THE INVENTION

The present invention provides for a regenerative method for decontaminating a surface having contaminated material, comprising the steps of a) providing a plurality of cation exchange columns connected in parallel in a decontamination circuit, wherein each column contains cation exchange resin; b) introducing a decontamination chemical solution comprising a chelant capable of binding to the cation exchange resin to the decontamination circuit; c) exposing the contaminated material to the decontamination chemical solution; d) exposing the decontamination chemical solution containing the contaminated material to the plurality of cation exchange columns for a time period sufficient to bind both the contaminated material and the chelant to the cation exchange resin and for a time period sufficient to subsequently release the chelant from the cation exchange resin, whereby only the contaminated material remains bound to the cation exchange resin; and e) injecting vanadous formate to the regenerated decontamination chemical solution for enhancing the overall solubility of contamination material in the decontamination chemical solution, whereby the decontamination chemical solution is utilized in a regenerative manner.

More particularly, the decontamination solution is a Low Oxidation-state Metal Ion decontamination chemical solution having a concentration between $10^{-3}$M–2M and wherein the chelant is picolinic acid.

It is further contemplated that the plurality of cation exchange columns are each exposed to the decontamination chemical solution containing contaminated material in a predetermined sequence wherein one column is releasing a portion of the chelant bound to the cation exchange resin while another column is binding a portion of the chelant to the cation exchange resin, whereby the predetermined sequence allows for the maintenance of a constant level of chelant in the decontamination circuit.

The method further comprises the step of exposing the regenerated LOMI decontamination chemical solution to an anion exchanger containing IONAC-365 for removing formate ions from the LOMI decontamination chemical solution.

BRIEF DESCRIPTION OF THE DRAWINGS

FIG. 3 illustrates a block diagram of the decontamination circuit of the present invention.

DETAILED DESCRIPTION OF THE PREFERRED EMBODIMENT

Figure 1:
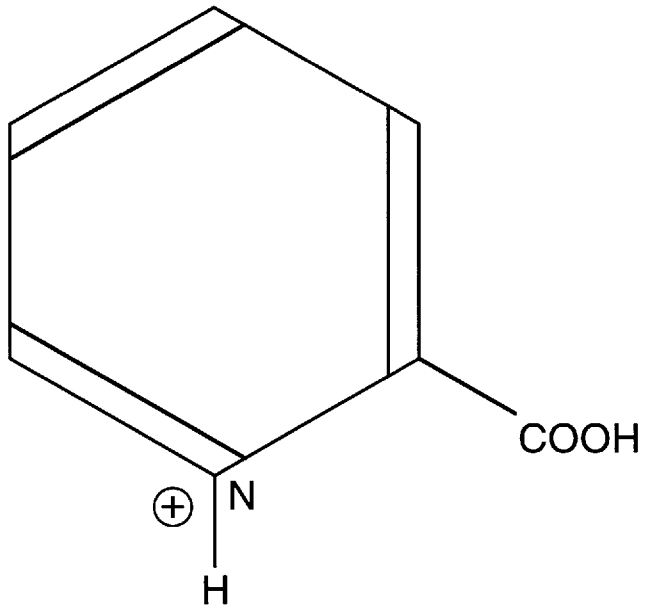
FIG. 1 illustrates protonation of a nitrogen atom in the heterocyclic structure.

The present invention provides for a regenerative LOMI decontamination process wherein cation exchange resin is used to remove contaminated materials (i.e. metals) from a LOMI decontamination chemical solution in the conventional manner (see, for example U.S. Pat. No. 4,705,573). The present invention, however, provides for additional operation of the cation exchange resin to allow the chelant (i.e. picolinic acid) initially bound to the resin, to be released and recycled back to the LOMI decontamination chemical solution circulating through the decontamination circuit. Operation of the cation exchange resin ceases after the picolinic acid has been released back to the circulating LOMI decontamination chemical solution but before the inorganic cations (e.g. metals such as sodium, iron and vanadium) are released back to the circulating LOMI decontamination chemical solution.

The present invention is regenerative because picolinic acid, which is the chelant used in the LOMI decontamination chemical solution, is recycled by using cation exchange resin to split the metal ion complex. Although vanadium would be removed by the cation exchange columns (together with the radioactive metals), it would be removed as spent vanadium (III), since there will be a small standing concentration of vanadium (II) in the decontamination solution. More vanadium can be added as fresh vanadium (II), thus enhancing the overall potential capacity of the decontamination process for corrosion product dissolution. In other words, the ability of the LOMI decontamination chemical solution to absorb contaminated material is increased.

The present invention, involves an initial injection of a dilute LOMI decontamination chemical solution (vanadous formate, picolinic acid and sodium hydroxide) into the decontamination circuit. The decontamination chemical solution is then passed through a cluster of small cation exchange columns during the decontamination process wherein the small cation exchange columns are situated in parallel with respect to one another. By "small cation exchange columns," it is meant that the size of the present columns are smaller than the columns used in conventional processes wherein all of the ions are removed at the end of the decontamination process.

The small cation exchange columns are operated according to a sequence wherein one column is releasing picolinic acid while another cation exchange column is binding picolinic acid. In this way, the process is operated without wide variations in the standing concentration of picolinic acid in the decontamination circuit. This procedure is coupled with continuous further additions of vanadous formate and sodium hydroxide. Optionally a weak base anion exchanger can be used during the process to remove formate (in preference to picolinic acid) from the system. Final clean-up is completed by larger cation and anion columns as described previously, but because the standing concentration of components is much lower than in a normal LOMI decontamination process, the amount of resin required in the larger cation and anion columns is greatly reduced.

Figure 2:
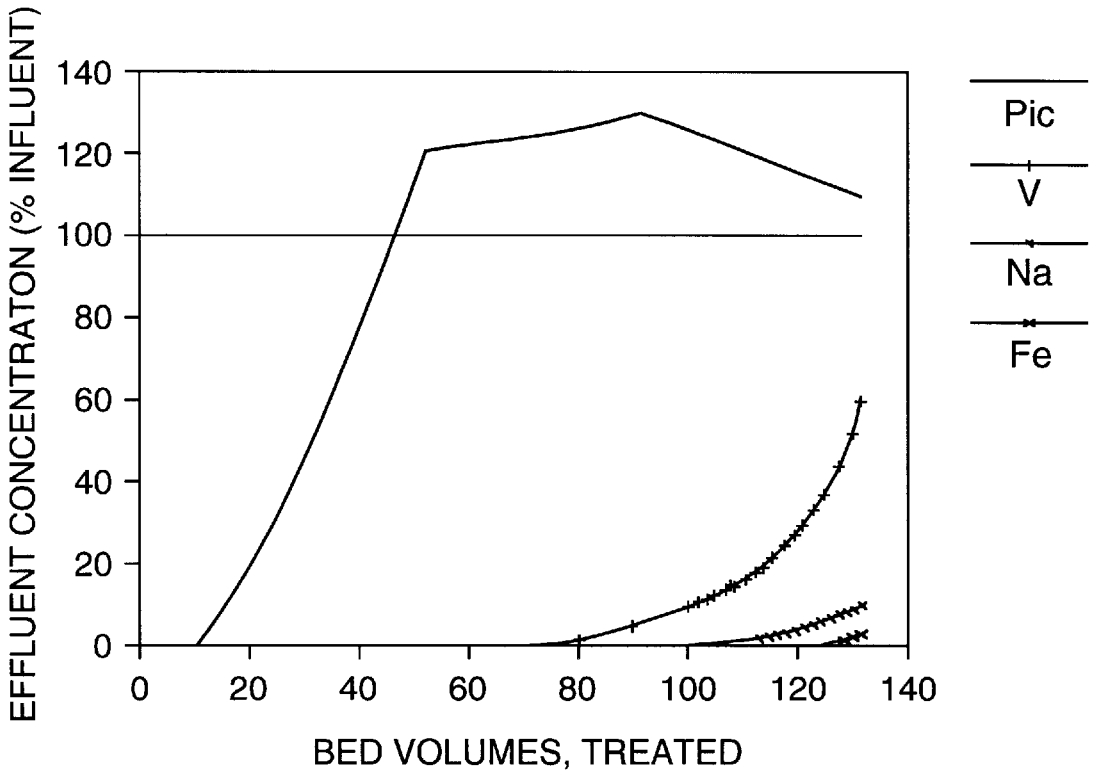
FIG. 2 illustrates a graph of the picolinic acid and metal ion breakthrough characteristics.

The specific operation of the cation exchange columns on a plant scale requires knowledge of the breakthrough characteristics of each species in a cation exchange column. The breakthrough characteristics can be predicted from a knowledge of the solution concentrations of the different species and the resin capacity, coupled with the assumption that all cations are initially removed, and that picolinic acid is eluted from the column before any other cations. An example of measured breakthrough characteristics is given in FIG. 2 which confirms this statement. The pre-estimated breakthrough points can be verified by appropriate analytical measurements of the column effluent during operation of the process.

FIG. 3 illustrates a schematic block diagram of a decontamination circuit implementing the present invention. The method begins with an initial injection of decontamination chemicals as described in U.S. Pat. No. 4,705,573. The concentrations used can be anywhere in the ranges described in that patent (i.e. $10^{-3}$M–2M, but preferably $10^{-3}$M–$10^{-2}$M), but at concentrations lower than those which would normally be used for a nonregenerative application. In the example provided below, 2 millimoles per liter of vanadium was used, which may be regarded as typical. Within the decontamination circuit, a return line 1 returns the decontamination chemical solution mixed with contaminated material from the reactor circuit to a number of small cation exchange columns 2, 4, 6, 8, and 10 are provided. The exact number of small cation exchange columns is not critical, but is preferably four or greater. If the ion exchange resin in the columns can be rapidly replaced with fresh resin during the decontamination process, three columns, or conceivably two, would be sufficient.

Following an initial injection of the dilute LOMI decontamination chemical solution, a first cation exchange column 2 is valved into the decontamination circuit. When picolinic acid starts to elute in the column effluent of the first cation exchange column 2, a second ion exchange column 4 is valved in into the decontamination circuit. The first cation exchange column 2 is valved out just before metal breakthrough occurs (i.e. before the contaminated metal is released from the resin). A third cation exchange column 6 is valved into the decontamination circuit when picolinic acid breakthrough occurs in the second cation exchange column. The cation exchange columns 2, 4, 6, 8, and 10 do not have to be operated continuously. The sequence is continued until all the cation exchange columns 2, 4, 6, 8, and 10 are opened to the decontamination circuit. However, as discussed above, if the resin in the columns can be replaced with fresh resin during the decontamination process, the decontamination process can be continued for as long as desired.

Formate ion is removed from the LOMI formulation on a weak base anion exchanger 12 such as an IONAC-365 (Manufactured by the Sybron Corporation, USA) at a capacity greater than 3 milliequivalents per milliliter, in comparison to a maximum capacity of 1.6 milliequivalents per liter for picolinic ion. An anion exchanger is necessary because the continuous addition of vanadous formate to the solution causes an increase in the concentration of formate ion in the absence of any mechanism for its removal. The use of a column of weak base resin, previously loaded with picolinic acid, can be used to reduce the concentration of formate in solution. If it is not convenient to condition the resin in this way, a column of hydroxide form weak base resin can be used, wherein the picolinic acid is first removed by the column and then eluted by influent formate ion.

The present invention also provides for additional injections of vanadous formate and sodium hydroxide from injector 14. A feed line 17 feeds the regenerated decontamination solution mixed with vanadous formate and sodium hydroxide to the reactor circuit. Final cleanup is completed by larger cation and anion columns 16 as described previously in U.S. Pat. Nos. 4,705,573 (see col. 6, lines 19–28) and 4,731,124 (see col. 5, lines 8–12).

The advantages of the invention present invention are a) the ability to dissolve more than 10 millimoles of iron per liter of solution; b) a reduced requirement for picolinic acid; c) a reduced volume of radioactive waste; and e) a reduced proportion of "chelants" in the waste.

Although the present invention is intended principally for use with the LOMI decontamination chemical process it can also be used with other processes which use a chelant capable of binding to a cation exchange resin.

EXAMPLE 1

An example test was performed utilizing the method of the present invention. This test incorporated a 10 liter perspex reservoir suitable to retain a LOMI decontamination chemical solution at 90° C. with nitrogen purge, and four cation exchange columns. The cation exchange columns were connected by a series of peristalic pumps for variable flow rate. The cation exchange columns were filled with 50 $cm^3$ of Amberlite IR-120 (H) strong acid cation exchange resin in the hydrogen form, pre-conditioned with 3 bed volumes 1M hydrochloric acid followed by approximately 10 bed volumes deionized water rinse.

As set forth in Table 1, 10 liters of dilute spent LOMI solution was then prepared. The reagents were added to deionized water at 90° C. in the system reservoir in the following order: picolinic acid, sodium hydroxide, cobalt standard, vanadous formate, and iron oxide. The mixture was allowed to circulate in the reservoir for approximately one hour under nitrogen prior to column initiation. This was to ensure that the dissolution of iron oxide by vanadium (II), and hence the attainment of a representative spent LOMI decontamination chemical solution.

TABLE 1

Spent Dilute LOMI Solution Formulation

| Species | Concentration | Reagents | Volume/ Weight in 10 liters |
|---|---|---|---|
| $V^{2+}$ | 2 mM | 0.13 M Vanadous Formate | 154 $cm^3$ |
| $Fe^{3+}$ | 2 mM | Iron Oxide ($Fe_2O_3$) | 1.67 g |
| $Co^{2+}$ | 0.2 $mgl^{-1}$ | 1025 $mgl^{-1}$ Cobalt Standard | 1950 $\mu l$ |
| NaOH | 6 mM | 10 M Sodium Hydroxide | 6.0 $cm^3$ |
| Picolinic Acid | 9 mM | Picolinc Acid | 11.08 g |

The ten liters of spent LOMI solution (maintained at 90° C. throughout the run) was passed through the multi-column system and the column effluent recycled as follows: Column I was switched on (others off) and the spent LOMI solution was passed through at 1.365 liter $h^{-1}$ (27.3 $bvh^{-1}$) until approximately half the column capacity was used. This point was determined from resin color observations and correlations between previous analytical results and resin color observations. Column II was switched on and the overall flow rate was increased to 2.4 liter $h^{-1}$, equivalent to 24 $bvh^{-1}$ per column. When half the capacity of column II was used, column I was at the point of metals breakthrough and hence switched off. Simultaneously, column III was switched on. The column switching routine was carried out in the same manner at the point of metals breakthrough for columns II and III. When column III was switched off the flow rate was decreased to 27.3 $bvh^{-1}$ for the remainder of the run whilst column IV was in operation independently.

During the course of the experiment the pH of the spent LOMI decontamination chemical solution in the reservoir was maintained above a pH of 3.5 by periodic addition of a 10M sodium hydroxide solution (total volume 31.5 $cm^3$). It was observed that columns II, III and IV reached metals breakthrough much more rapidly than was anticipated from characterization tests in which the column effluent was not recycled, due to the build up of sodium formate in the system as discussed elsewhere.

The vanadium and iron concentrations were maintained in the spent LOMI decontamination chemical solution by slowly bleeding in a solution of 5.007 g iron oxide dissolved in 462 $cm^3$ 0.13M vanadous formate under nitrogen (the correct proportions for 30 liters of dilute LOMI decontamination chemical solution). The total volume introduced into the reservoir was 270 $cm^3$ at a flow rate of 20 $cm^3h^{-1}$.

Throughout the run, 50 $cm^3$ samples were collected for analysis from the column effluents approximately 5 minutes following each column switch and during the progress of each column. Samples were also taken at least every two hours from the reservoir. The loss of recycled picolinic acid from the reservoir due to sampling was compensated for by the addition of 50 $cm^3$ aliquots of 1.4 $gl^{-1}$ picolinic acid solution. (~1.4 $gl^{-1}$ was the estimated average picolinic acid concentration of the column effluents from previous tests).

During this test, the reservoir concentrations of iron and vanadium were found to be nearly constant at 100 and 150 ppm respectively due to balance between additions of these components and their removal by cation exchange. Picolinic acid was successfully recycled, as evidence by its concentration remaining constant in the region of 6–8 millimoles per liter throughout the test, despite addition of picolinic acid only being made to compensate for that removed in samples. The ion exchange columns treated progressively less volume of solution, (due to the formate build up) starting at 260 bed volumes for the first column and falling progressively to 180 bed volumes for the last column. This should be compared with a predicted theoretical capacity of 265 bed volumes. Analysis indicated that at no stage were iron or cobalt detectable in the effluent from the ion exchange columns.

While the present invention has been described in detail by way of illustration and example for purposes of clarity of understanding, it will be understood by those skilled in the art that certain changes and modifications may be made to the above-described embodiments without departing from the spirit of the invention and scope of the appended claims.

What is claimed is:

1. A regenerative method for decontaminating a surface having contaminated material, comprising the steps of:

a) providing a plurality of cation exchange columns connected in parallel in a decontamination circuit wherein each column contains cation exchange resin;

b) introducing a Low Oxidation-state Metal Ion (LOMI) decontamination chemical solution containing picolinic acid to the decontamination circuit;

c) exposing the contaminated material to the LOMI decontamination chemical solution;

d) exposing the LOMI decontamination chemical solution containing the contaminated material to the plurality of cation exchange columns for a time period sufficient to bind both the contaminated material and the picolinic acid to the cation exchange resin and for a time period sufficient to subsequently release the picolinic acid from the cation exchange resin, whereby only the contaminated material remains bound to the cation exchange resin; and e) injecting vanadous formate to the regenerated decontamination chemical solution for enhancing the overall solubility of contamination material to the decontamination chemical solution, whereby the LOMI decontamination chemical solution is utilized in a regenerative manner.

2. The method of claim 1 wherein the plurality of cation exchange columns are each exposed to the LOMI decontamination chemical solution containing contaminated material in a predetermined sequence wherein one column is releasing a portion of the picolinic acid bound to the cation exchange resin while another column is binding a portion of the picolinic acid to the cation exchange resin, whereby the predetermined sequence allows for the maintenance of a constant level of picolinic acid in the decontamination circuit.

3. The method of claim 1 wherein the LOMI decontamination chemical solution has a concentration of between $10^{-3}$M–2M.

4. The method of claim 1 further comprising the step of exposing the regenerated LOMI decontamination chemical solution to an anion exchanger for removing formate ions from the LOMI decontamination chemical solution.

5. The method of claim 4 wherein the anion exchanger comprises IONAC-365.

6. A regenerative method for decontaminating surfaces of a nuclear plant cooling system having contaminated material, comprising the steps of:

a) providing a plurality of cation exchange columns connected in parallel in a decontamination circuit wherein each column contains cation exchange resin;

b) introducing a Low Oxidation-state Metal Ion (LOMI) decontamination chemical solution containing picolinic acid to the decontamination circuit;

c) exposing the contaminated material to the LOMI decontamination chemical solution;

d) exposing the LOMI decontamination chemical solution containing the contaminated material to the plurality of cation exchange columns for a time period sufficient to bind both the contaminated material and the picolinic acid to the cation exchange resin and for a time period sufficient to subsequently release the picolinic acid from the cation exchange resin, whereby only the contaminated material remains bound to the cation exchange resin; and e) injecting vanadous formate to the regenerated decontamination chemical solution for enhancing the overall solubility of contamination material to the decontamination chemical solution, whereby the LOMI decontamination chemical solution is utilized in a regenerative manner.

7. The method of claim 6 wherein the plurality of cation exchange columns are each exposed to the LOMI decontamination chemical solution containing contaminated material in a predetermined sequence wherein one column is releasing a portion of the picolinic acid bound to the cation exchange resin while another column is binding a portion of the picolinic acid to the cation exchange resin, whereby the predetermined sequence allows for the maintenance of a constant level of picolinic acid in the decontamination circuit.

8. The method of claim 6 wherein the LOMI decontamination chemical solution has a concentration of between $10^{-3}$M–2M.

9. The method of claim 6 further comprising the step of exposing the regenerated LOMI decontamination chemical solution to an anion exchanger for removing formate ions from the LOMI decontamination chemical solution.

10. The method of claim 9 wherein the anion exchanger comprises IONAC-365.

* * * * *

UNITED STATES PATENT AND TRADEMARK OFFICE

CERTIFICATE OF CORRECTION

PATENT NO. : 5,805,654
DATED : September 08, 1998
INVENTOR(S) : Wood et al

It is certified that error appears in the above-identified patent and that said Letters Patent is hereby corrected as shown below:

The sheet of drawing consisting of Figure 3 should be deleted to appear as per attached.

Signed and Sealed this

Twenty-seventh Day of April, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,805,654

DATED : September 08, 1998

INVENTOR(S) : Wood, et al.

It is certified that error appears in the above-identified patent and that said Letters Patent is hereby corrected as shown below:

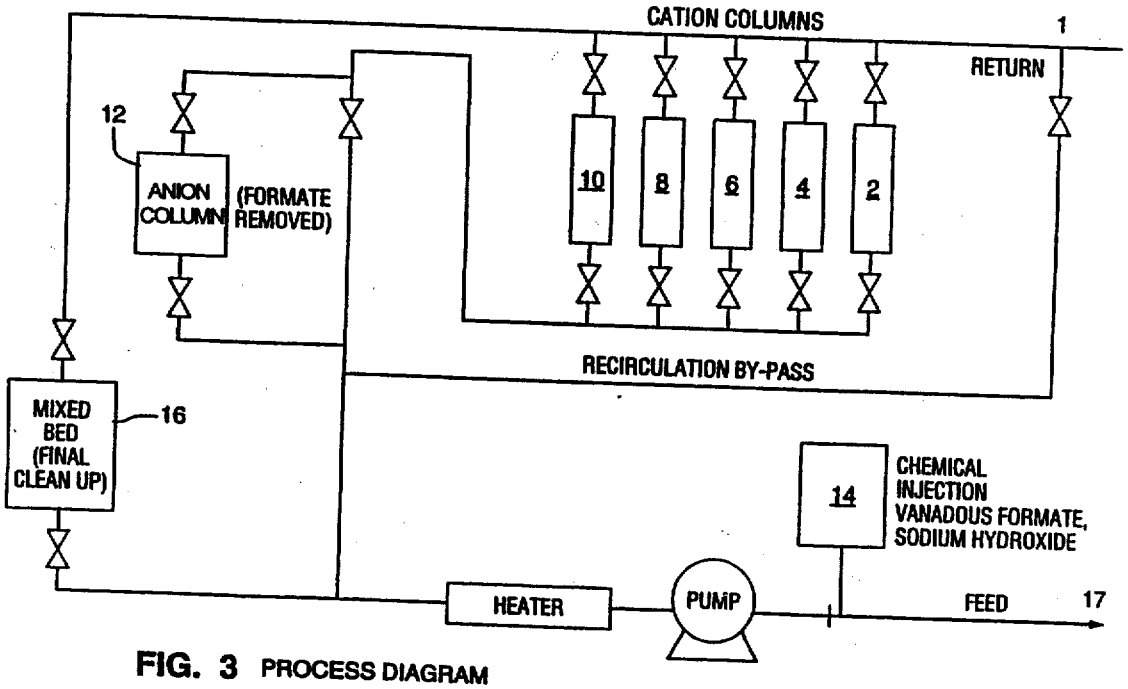

FIG. 3 PROCESS DIAGRAM